United States Patent [19]

Goings

[11] 4,068,802

[45] Jan. 17, 1978

[54] SPRAYING SYSTEM TO CONTROL AIR-BORNE COAL DUST

[76] Inventor: Shelby H. Goings, Rte. No. 7, Princeton, W. Va. 24740

[21] Appl. No.: 699,809

[22] Filed: June 25, 1976

[51] Int. Cl.[2] ..... F04F 5/02

[52] U.S. Cl. ..... 239/419.5; 98/50; 239/428.5; 261/116; 417/151

[58] Field of Search ..... 239/9, 419.5, 428.5, 239/434.5; 417/151, 155, 158, 160, 174, 179, 181, 195; 98/50; 261/24, 25, 28, 76, 116, DIG. 75, DIG. 54

[56] References Cited

U.S. PATENT DOCUMENTS

| | | | |
|---|---|---|---|
| 490,583 | 1/1893 | McClave | 417/179 X |
| 3,570,472 | 3/1971 | Santangelo | 261/116 X |
| 3,907,208 | 9/1975 | Agnew et al. | 239/428.5 |

FOREIGN PATENT DOCUMENTS

| | | | |
|---|---|---|---|
| 52,821 | 3/1937 | Denmark | 261/116 |
| 2,323,159 | 11/1973 | Germany | 98/50 |

*Primary Examiner*—Evon C. Blunk
*Assistant Examiner*—Andres Kashnikow
*Attorney, Agent, or Firm*—Clarence A. O'Brien; Harvey B. Jacobson

[57] ABSTRACT

A spraying system for controlling air-borne particulate matter, such as coal dust, has a housing including a diverging diffuser portion into which a spray of liquid is injected. The spray causes a flow of air to pass into the diffuser portion and mix with the liquid to form a mist which passes from the diffuser portion to form a diverging jet downstream of the outlet of the diffuser portion. This diverging jet causes air molecules to be drawn into the mist and removed from the air through which the mist is passing.

5 Claims, 3 Drawing Figures

12
2
C
16
38
10
40
22
28
3
2
14
3
H
30
36
26

28
24
16
34

22
S
30
26

C
14
34
20
38
26
42
18

16
40
32
22
30
36

SPRAYING SYSTEM TO CONTROL AIR-BORNE COAL DUST

BACKGROUND OF THE INVENTION

1. Field of the invention

This invention relates generally to air washing apparatus, and particularly to apparatus for washing coal dust and the like, from a mine shaft.

2. Description of the Prior Art

Spraying systems are commonly employed in coal mines, and the like, which concentrate a spray against the generating point of coal dust and other particulate matter. The efficiency of such known spraying systems, however, is rather low, and the spray has a tendency to carry beyond a desired point and interfere with the work of miners working downstream of the spray. In addition, the spray intends only to push against the dust and other particulate matter, which only results in the dust being moved around, and not removed from the air as is the object of the spraying system.

It has been proposed to use a diffuser employing a liquid spray in order to collect particulate matter in a coal mine, and the like. See U.S. Pat. No. 3,907,208, issued Sept. 23, 1975 to J. M. Agnew et al. This known device works in the manner of a conventional diffusion pump inasmuch as the particulate-laden air is drawn into a duct upstream of a liquid spray so as to be drawn along by the spray in much the manner as air molecules are drawn out of a vacuum chamber by a diffusion pump. Wetting of the particulate matter will cause this matter to fall to the floor of the shaft, whereby the air is rid of it.

One principal reason for removing coal dust and similar particulate matter from a coal mine shaft, other than the health of the miners and the efficiency of equipment in the mine, is that the coal dust can cause explosions within the mine. See U.S. Pat. Nos. 1,735,927, issued Nov. 19, 1929 to L. Kessler, and 3,164,079, issued Jan. 5, 1965 to A. F. Ross, for examples of mine safety apparatus intended to prevent such build-up of dust, gases, and the like, in mines so as to cause an explosion or toxic breathing conditions for the miners.

SUMMARY OF THE INVENTION

It is an object of the present invention to provide a spraying system for controlling air-borne particulate matter which is simple yet reliable of construction, and more efficient than previously proposed spraying systems.

It is another object of the present invention to provide a spraying system for controlling air-borne particulate matter which concentrates against the air-borne particulate matter as opposed to being concentrated against a point of generation of the particulate matter.

It is still another object of the present invention to provide a spraying system for controlling air-borne particulate matter which is capable of collecting particulate matter as a function of the amount of spray employed when compared to previously proposed spraying systems.

These and other objects are achieved according to the present invention by providing a spraying system having: a housing including a diverging diffuser portion having an entrance and an outlet; a spray nozzle disposed at the entrance of the diverging diffuser portion and arranged for directing a liquid spray toward the outlet of the diffuser portion; with the housing further including an air intake portion connected to the entrance of the diffuser portion for mixing air with the liquid spray and forming a diverging mist which attracts and entrains particulate matter from air adjacent the diverging flow path of the mist.

According to a preferred embodiment of the invention, the spray nozzle includes a pipe extending through the housing adjacent the entrance of the diffuser portion and connected to a source of fluid, such as water, under pressure. A diverging spray outlet orifice is mounted on the pipe substantially centrally located within the entrance to the diverging diffuser portion for receiving the fluid from the pipe and spraying the fluid into the diffuser portion.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
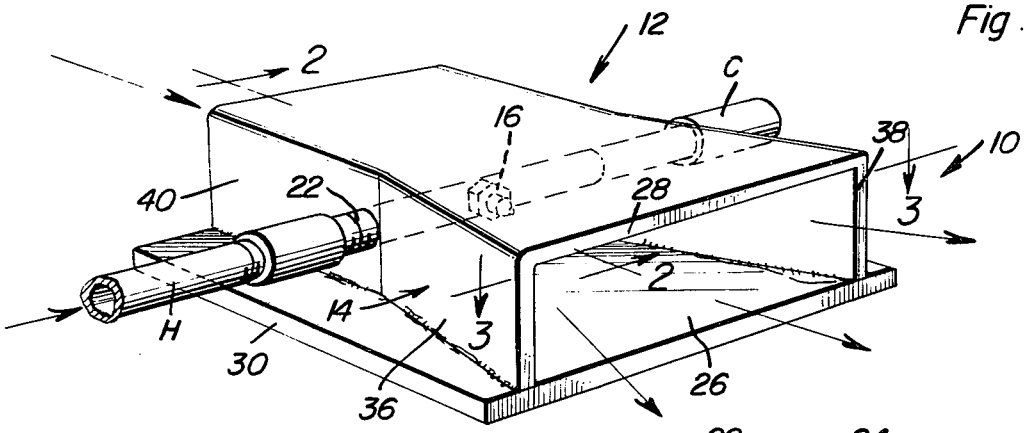
FIG. 1 is a fragmentary, perspective view showing a spraying device according to the present invention.
Figure 2:
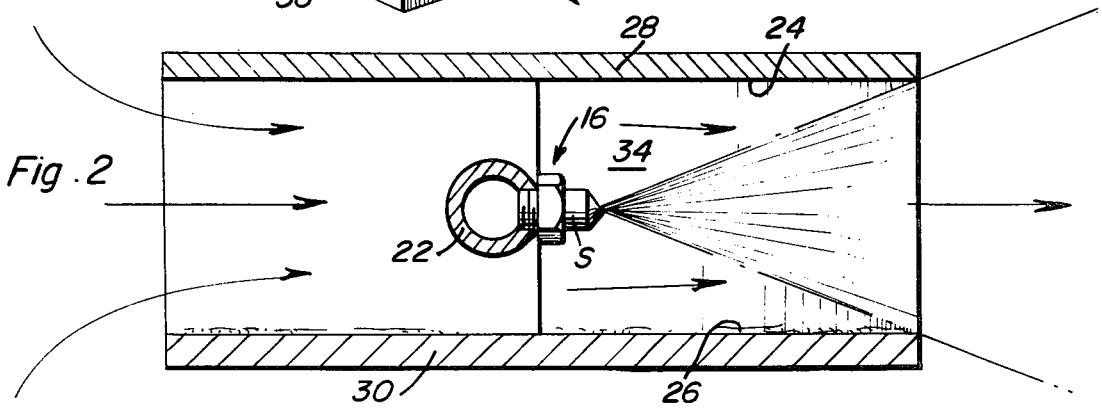
FIG. 2 is an enlarged, sectional view taken generally along the line 2—2 of FIG. 1.
Figure 3:
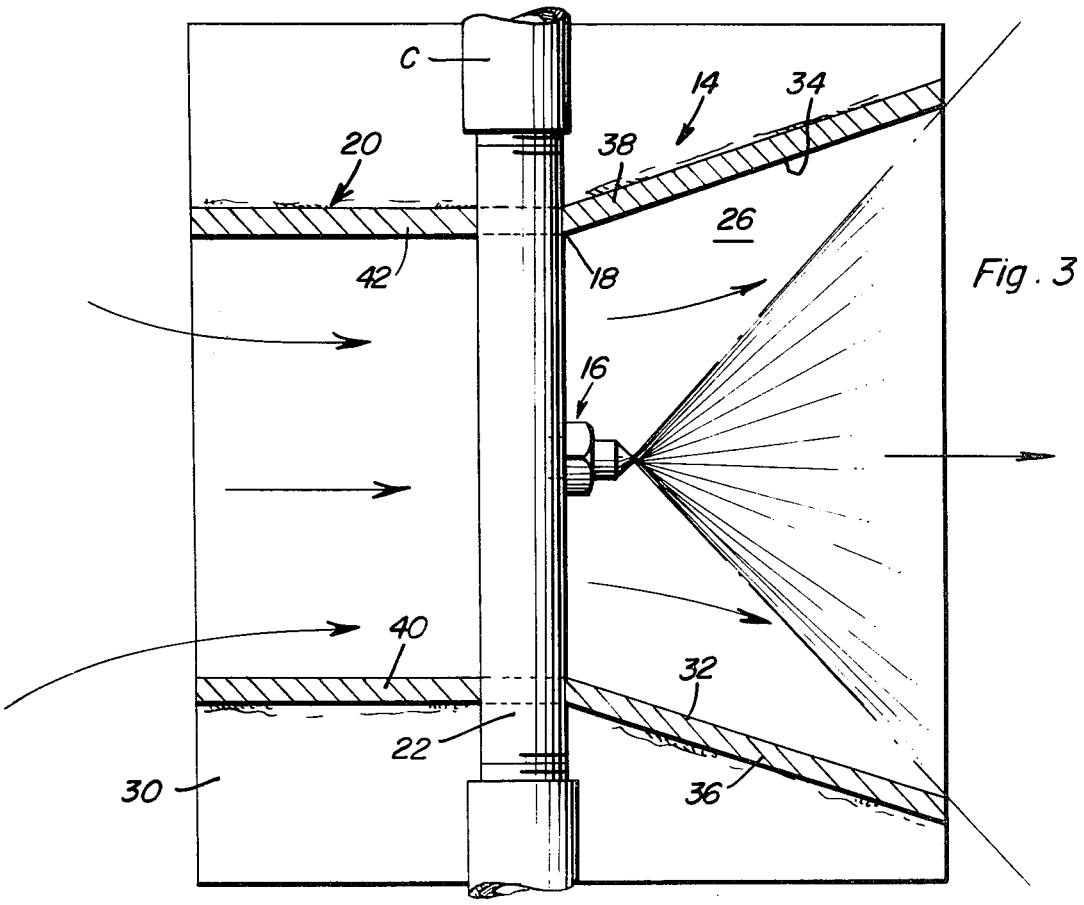
FIG. 3 is an enlarged, fragmentary, sectional view taken generally along the line 3—3 of FIG. 1.

Referring now more particularly to the figures of the drawing, a spraying system according to the present invention for controlling air-borne coal dust and other particulate matter includes a device 10 comprising a housing 12 partially formed by a diffuser portion 14 in which is arranged a spray nozzle 16. More specifically, nozzle 16 is arranged at an entrance 18 of the diffuser portion 14, from which entrance 18 the diffuser portion 14 diverges toward an outlet. Housing 12 is also partially formed by an air intake portion 20 connected to portion 14 at the entrance 18 thereof for permitting air to be drawn into a liquid spray emitted from nozzle 16 and mixing the air with the liquid spray in order to form a diverging stream of a mist which will attract and entrain particulate matter from air adjacent the path of the mist downstream of diffuser portion 14. The flow arrows in the drawings indicate the flow of air into housing 12 and the flow of mist from the housing 12 in the form of a diverging stream.

Nozzle 16 includes a pipe 22 extending through housing 12 adjacent entrance 18 of portion 14 and connected to a suitable source (not shown) of an operating fluid for the device 10. Ideally, the operating fluid is water, and pipe 22 is connected to a conventional water hose H, and the like, at one end and is capped off as shown at C at the other end. Mounted on pipe 22 is a conventional orifice-forming liquid spray element S for receiving the liquid from pipe 22 and spraying the liquid into portion 14.

According to the preferred embodiment illustrated in the figures of the drawing, the diffuser portion 14 diverges only parallel to the longitudinal extent of pipe 22. That is, only the walls of portion 14 which are transverse to the longitudinal extent of pipe 22 diverge.

Housing 12 is advantageously of a rectangular cross section, with the pipe 22 being disposed extending across a longer dimension of the entrance 18 of portion 14. Forming the flow passage for the liquid and air through housing 12 are a pair of faces 24 and 26 formed by a substantially planar top wall 28 and a bottom plate 30, respectively. Diffuser portion 14 is also partially formed by sides 32 and 34 formed by a pair of side walls 36 and 38 connected to and extending between wall 28 and plate 30. Also connected to an extending between wall 28 and plate 30 are a pair of walls 40 and 42 which complete the intake portion 20 of housing 12.

Plate 30 is advantageously provided for facilitating mounting of device 10 on a continuous mining machine (not shown) and the like in such a manner as to direct the mist spray from device 10 into particulate-laden air.

As will be appreciated, the diffuser portion 14 is essentially a subsonic diffuser which functions to draw air through portion 20 and into the spray of liquid in order to form the desired mist which will attract and retain particulate-laden inner molecules adjacent the mist spray. Tests have found that by using a device 10 having an outlet to portion 14 8 inches wide and 3 inches high and an inlet to portion 20 5 inches wide and 3 inches high, 150 pounds per square inch of water pressure going into pipe 22 will cause 526 cubic feet per minute of air to pass into portion 20 and mix with the water coming out of the spary head S. The water from spray head S may travel, for example, 3⅛ inches to the outlet of portion 14. By this time, the air has mixed with the water so as to break the water up into a mist. This mist traveled 25 feet out from portion 14, and expanded, or diverged, to 20 feet wide and 3 feet high at its furthest outward point. By putting two sprays approximately 2 feet apart, it was possible to put 550 cubic feet of air per minute between two mists of water. Further, at 350 lbs. per square inch of water pressure into pipe 22, a single device 10 will pull 1,056 cubic feet of air a minute. Studies have shown that, for example, only the first 8 to 10 feet of the mist spray will actually draw the particulate matter thereinto, and the rest of the spray has a pushing effect. This is due, of course, to the tendency of the diffused mist to approach static pressure. Accordingly, the exact dimensions of device 10, as well as the water pressure and volume of air passed therethrough, will be optimized in order to maximize the effective volume of the mist spray which will wash the surrounding air.

When device 10 is installed on a continuous mining machine (not shown), it can be directed toward a cutting head so as to cover the head with the mist of water at any point of the head as the head is running up and down a vein of coal. By so covering the cutting head with the water mist, the chances of a dangerous fire and/or explosion should methane in the shaft be ignited is decreased because of the cooling effect of the mist. Thus, the spent mist spray can serve another important function in addition to cleaning the air in the shaft.

The number and duration of "sprays" will vary as a function of the kind of mining equipment being used and the amount of particulate matter it puts into the air in a mine shaft, and the like. Not only can a spray device according to the invention be used with mining equipment such as continuous mining machines, however, but with conventional loading machines and at coal transfer points, and the like, as well. Further, the return air in the mine can also be sprayed in order to reduce the coal dust therein and prevent mine explosions.

As will be appreciated from the above description and from the drawings, a spraying system according to the present invention will provide in a simple and inexpensive yet rugged and reliable manner the washing of air in mine shafts, and the like, so as to reduce health hazard to miners and reduce the possibility of a mine explosion.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

What is claimed as new is as follows:

1. A spraying system for controlling airborne particulate matter, comprising, in combination:
   a. a short open-ended housing including a subsonic diffuser portion having an entrance and an outlet, the diffuser portion diverging from the entrance to the outlet;
   b. a liquid spray nozzle means including a pipe arranged transversely of the housing and mounting adjacent the entrance of the diffuser portion a diverging spray head disposed at the entrance of the diffuser portion for directing a diverging spray toward the outlet of the diffuser portion; and
   c. the housing further including air intake means connected to the entrance of the diffuser portion and forming a passage of constant cross-sectional area and of the same size and cross-sectional configuration as the entrance to the diffuser portion and simultaneously forming an extension of the entrance of the diffuser portion, the passage extending from the entrance of the diffuser substantially the same distance as the outlet of the diffuser portion extends from the entrance of the diffuser portion for mixing air with the liquid spray and forming a mist which attracts and entrains particulate matter from air adjacent the mist downstream of the diffuser portion.

2. A structure as defined in claim 1, wherein the pipe is connected to a source of liquid under pressure, the diverging spray head receiving a liquid from the pipe and spraying the liquid into the diffuser portion.

3. A structure as defined in claim 2, wherein the diffuser portion diverges parallel to the extent of the pipe.

4. A structure as defined in claim 2, wherein the housing is of rectangular cross section, with the pipe being disposed extending across a longer dimension of the entrance of the diffuser portion.

5. A structure as defined in claim 4, wherein the diffuser portion diverges parallel to the extent of the pipe.

* * * * *